US006456717B1

(12) United States Patent
Nowka et al.

(10) Patent No.: US 6,456,717 B1
(45) Date of Patent: Sep. 24, 2002

(54) SYSTEM FOR ASSURING PROPER ACOUSTIC CONNECTION OF A DEVICE UNDER TEST TO A TEST FIXTURE

(75) Inventors: Dennis R. Nowka, Thornton; Gene M. Uba, Broomfield, both of CO (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/236,856

(22) Filed: Jan. 25, 1999

(51) Int. Cl.[7] ..... H04R 29/00

(52) U.S. Cl. ..... 381/58; 381/60; 381/58; 379/1.01

(58) Field of Search ..... 381/320, 316, 381/93, 83, 58, 59, 60, 56, 57, 318; 379/1.01

(56) References Cited

U.S. PATENT DOCUMENTS

| | | | | | |
|---|---|---|---|---|---|
| 1,426,807 | A | * | 8/1922 | Arnold et al. | 331/178 |
| 4,065,647 | A | * | 12/1977 | Frye et al. | 381/60 |
| 5,412,734 | A | * | 5/1995 | Thomasson | 381/318 |
| 5,577,511 | A | * | 11/1996 | Killion | 381/60 |

FOREIGN PATENT DOCUMENTS

| | | | | |
|---|---|---|---|---|
| DE | 3911980 C1 | * | 7/1990 | H04M/01/24 |
| JP | 58036058 A | * | 3/1983 | H04M/01/21 |

OTHER PUBLICATIONS

The Institute of Electrical and Electronic Engineers, Inc., IEEE Standard for Measuring Transmission Performance of Telephone Sets, Published by The Institute of Electrical and Electronics Engineers, Inc., New York, NY 10017. Nov. 29, 1979.

The Institute of Electrical and Electronic Engineers, Inc., IEEE Standard Method for Determining Objective Loudness Ratings of Telephone Connections, Published by The Institute of Electrical and Electronics Engineers, Inc., New York, NY 10017. Nov. 29, 1979.

* cited by examiner

*Primary Examiner*—Forester W. Isen
*Assistant Examiner*—Tony M. Jacobson
(74) *Attorney, Agent, or Firm*—Patton Boggs LLP

(57) ABSTRACT

The system for assuring proper acoustic connection of a device under test to a test fixture generates an audible test signal external to the telephone handset-acoustic coupler interconnection to test the efficacy of the coupling of the telephone handset to the acoustic coupler of the test fixture. In particular, when the telephone handset is mounted in the acoustic coupler of the test fixture, this acoustic coupling should substantially block all audio signals that are present external to the acoustic coupler-telephone handset interconnection, from reaching the audio detector that is located in the acoustic coupler of the test fixture. Failure to substantially block the external audio signals indicates the inefficient mounting of the telephone handset in the test fixture. To determine whether the telephone handset is properly mounted in the acoustic coupler, the system for assuring proper acoustic connection of a device under test to a test fixture generates a test signal of audio frequency outside the bandwidth of the telephone handset and outputs this audio test signal proximate the telephone handset when it is mounted in the test fixture and external to the acoustic coupler-telephone handset interconnection. If the test signal is detected by the audio detector that is mounted in the acoustic coupler, then it is indicative of improper mounting of the telephone handset in the test fixture.

17 Claims, 2 Drawing Sheets

SYSTEM FOR ASSURING PROPER ACOUSTIC CONNECTION OF A DEVICE UNDER TEST TO A TEST FIXTURE

FIELD OF THE INVENTION

This invention relates to test systems and, in particular, to a system for assuring that a device under test is properly acoustically coupled to a test fixture prior to the execution of the acoustic tests by the test fixture on the device under test.

PROBLEM

It is a problem in the field of acoustic testing of a device to ensure the proper acoustic coupling of the device under test to the test fixture. In particular, a device under test typically undergoes a plurality of tests to ensure its proper operation as part of the device manufacturing process. Where the manufactured device includes acoustic elements, the response of these acoustic elements to predetermined test inputs are measured to guarantee proper operation of these acoustic elements.

For example, in the case of telephone handsets, the handset includes an earpiece and a mouthpiece, that are equipped with a handset receiver and a handset transmitter, respectively. The handset transmitter is responsive to the presence of a user's voice to generate electrical signals that correspond to the user's voice, for transmission over the telephone network to a destination telephone set. Similarly, the telephone handset includes handset receiver located in the earpiece to receive the transmitted electrical signals corresponding to a calling party's voice signals and produce an audio output that accurately reproduces the calling party's voice input. To test the operation of the handset transmitter and receiver contained in the telephone handset mouthpiece and earpiece, respectively, a set of industry-standard tests are executed on the device under test. Typical test definitions can be found in the publications "IEEE Standard Method for Measuring Transmission Performance of Telephone Sets" and "IEEE Standard Method of Determining Objective Loudness Ratings of Telephone Connections." These publications document standardized tests that are preformed on telephone handsets to verify their operational capabilities.

To implement the tests that are defined in the above-noted publications, test fixtures have been designed to enable the telephone handset to be mounted thereon, to receive test signals and measure audio signals output by the telephone handset. The test fixtures of necessity entail mounting the device under test to the test fixture via an acoustic coupler that places the earpiece of the telephone handset in close proximity to an audio detector in the test fixture that functions to measure the audio output of the telephone handset in response to the application of standardized test signals thereto. However, a problem with existing test fixtures is that it is difficult to ensure the consistent mounting of a telephone handset in the acoustic coupler that is part of the test fixture. The mounting of the telephone handset is a function of the accuracy of the operator who is running the test. If the telephone handset is not accurately mounted in the acoustic coupler, the test results are inaccurate. In a worst case situation, where the mounting of the telephone handset is grossly misaligned with the acoustic coupler, the telephone handset can fail the test, thereby necessitating the remounting of the handset and reexecution of the test to determine whether the test failure was a result of operator error of true failure of the telephone handset. In addition, the test results obtained from existing test fixtures vary widely and it is difficult to obtain an accurate representation of the true audio response of the telephone handset to the applied test signals due to the audio coupling limitations introduced by the acoustic coupler. Therefore, existing test fixtures simply identify gross anomalies, and produce a simple pass/fail response rather than producing accurate representations of telephone handset performance.

SOLUTION

The above described problems are solved and a technical advance achieved by the present system for assuring proper acoustic connection of a device under test to a test fixture, which generates an audible test signal external to the telephone handset-acoustic coupler interconnection to test the efficacy of the coupling of the telephone handset to the acoustic coupler of the test fixture. In particular, when the telephone handset is mounted in the acoustic coupler of the test fixture, this acoustic coupling should substantially block all audio signals that are present external to the acoustic coupler-telephone handset interconnection, from reaching the audio detector that is located in the acoustic coupler of the test fixture. Failure to substantially block the external audio signals indicates the inefficient mounting of the telephone handset in the test fixture.

To determine whether the telephone handset is properly mounted in the acoustic coupler, the system for assuring proper acoustic connection of a device under test to a test fixture generates a test signal of audio frequency outside the bandwidth of the telephone handset and outputs this audio test signal proximate the telephone handset when it is mounted in the test fixture and external to the acoustic coupler-telephone handset interconnection. If the test signal is detected by the audio detector that is mounted in the acoustic coupler, then it is indicative of improper mounting of the telephone handset in the test fixture. Furthermore, the magnitude of the detected test signal is indicative of the degree of audio leakage into the acoustic coupler-telephone handset interconnection and this information can be used to adjust the results of the test process if the telephone handset interconnection is adequate for test purposes, but not optimal. Once the test signal is applied and the output of the audio detector measured, the test process can continue.

DETAILED DESCRIPTION

Figure 1:
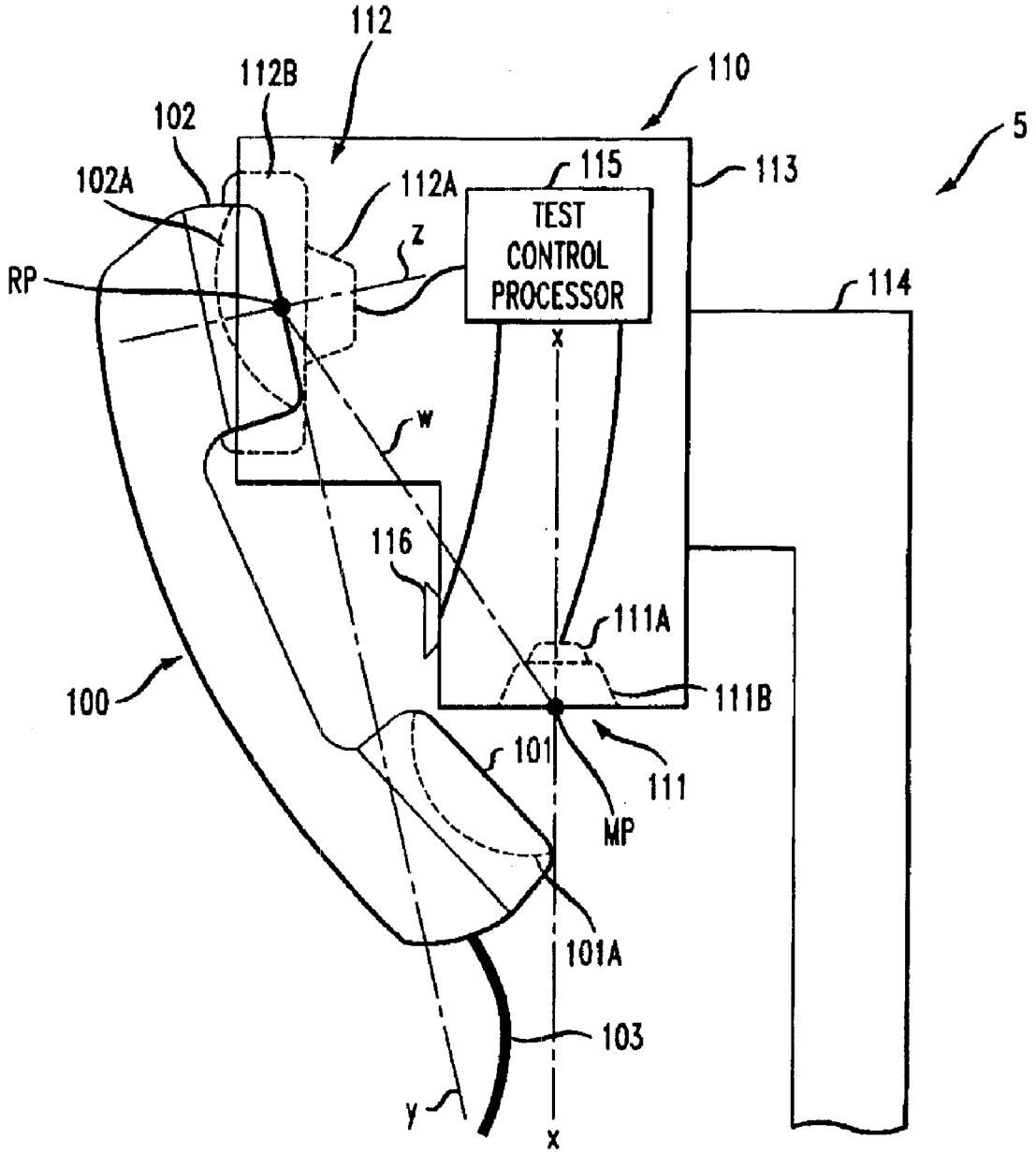
FIG. 1 illustrates in block diagram form the present system for assuring proper acoustic connection of a device under test to a test fixture, with a device under test installed therein.

As shown in FIG. 1, to test the operation of the handset transmitter 101A and handset receiver 102A contained in the telephone handset mouthpiece 101 and earpiece 102, respectively, a set of industry-standard tests are executed on the telephone handset 100 under test. The industry-standard test definitions can be found in the publications "IEEE Standard Method for Measuring Transmission Performance of Telephone Sets" and "IEEE Standard Method of Determining Objective Loudness Ratings of Telephone Connections." These publications document standardized tests that are preformed on telephone handsets to verify their operational capabilities. The tests require the use of a test fixture 110 that includes an artificial mouth 111, an artificial ear 112, standard circuits that comprise the DC power feed and telephone connecting loops (part of test processor 115). The test fixture 110 is intended for use in measuring the transmission characteristics of the telephone handset 100 over the frequency range most useful for speech: 200 Hz to 5,000 Hz. The test fixture 110 is used for single frequency measurements as well as for measurements with varying frequencies.

Architecture of the Test Fixture

FIG. 1 illustrates in block diagram form the present system S for assuring proper acoustic connection of a device under test to a test fixture 110, with a device under test 100 installed therein. To implement the tests that are defined in the above-noted publications, test fixture 110 is used to enable the telephone handset 100 to be mounted thereon, to receive test audio signals from the test fixture 110 and to enable the test fixture 110 to measure audio signals output by the telephone handset 100. The test fixture 110 of necessity entails mounting the telephone handset 100 to the test fixture 110 via an acoustic coupler 112B that places the earpiece 102 of the telephone handset 100 in close proximity to an audio detector 112A in the test fixture 110. The test fixture includes a test processor 115 that functions to measure the audio output of the telephone handset 100 in response to the application of standardized test signals thereto. To provide proper room for executing the test, the test fixture 110 is mounted on a support 114 to provide ample room to place the telephone handset 100 in the test fixture 110 in an orientation that corresponds to that used by a human when using the telephone handset 100.

In particular, the device under test 100 illustrated herein comprises a telephone handset 100 which includes an earpiece 102 and a mouthpiece 101, that are equipped with a handset receiver 102A and a handset transmitter 101A, respectively. The handset transmitter 101A is responsive to the presence of a user's voice to generate electrical signals that correspond to the user's voice, for transmission over the telephone network to a destination telephone set. Similarly, the telephone handset 100 includes a handset receiver 102A located in the earpiece 102 to receive the transmitted electrical signals corresponding to a calling party's voice signals and produce an audio output that accurately reproduces the calling party's voice input. In the standards definitions described in the above-noted publications, the artificial ear 112 comprises a device for the measurement of the acoustic output of telephone handset receiver 102A. The artificial ear 112 presents to the telephone handset receiver 102A an acoustic impedance that approximates the impedance presented by the human ear. Similarly, the artificial mouth 111 comprises an electro-acoustic transducer 111A that produces a sound field that simulates the output received from a typical human talker. The reference point RP for the telephone handset receiver 102A is the center of the circular plane of contact of the telephone handset earpiece 112 and the user's ear. The test fixture 110 is architected to simulate a modal head, comprising the dimensions typical for a human head, as specifically defined in the above-noted standards publications. The modal point MP is the position of the center of the lips of a modal head and the corresponding reference point of the artificial mouth, which is the center of the external plane of the lip ring 111. The modal position of the telephone handset 100 comprises the position a telephone handset 100 assumes when the earpiece 112 of the telephone handset 100 is held in close contact with the ear of the modal head and the modal direction (line W) is the plane defined by the axes of the earpiece and the artificial mouth. Line Y is the plane of the earpiece and the modal ear. Line X comprises the axis of the artificial mouth 111.

Operation of the Test Fixture

Figure 2:
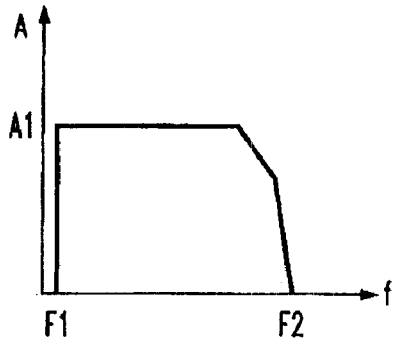
FIGS. 2 and 3 illustrate frequency response diagrams for the test fixture and the telephone handset, respectively.
Figure 3:
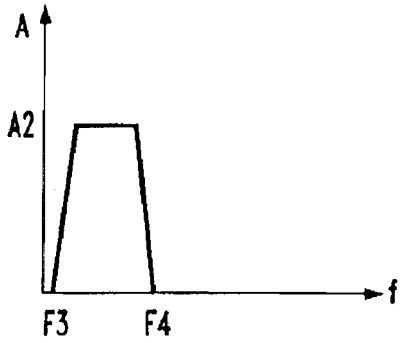
Figure 4:
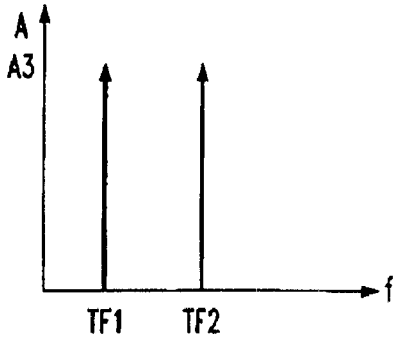
FIGS. 4 and 5 illustrate test frequency diagrams for the signals applied to the test fixture and the output from the telephone handset, respectively.
Figure 5:
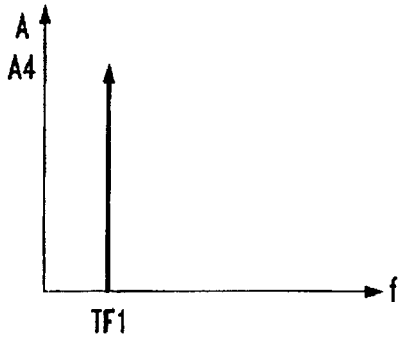
Figure 6:
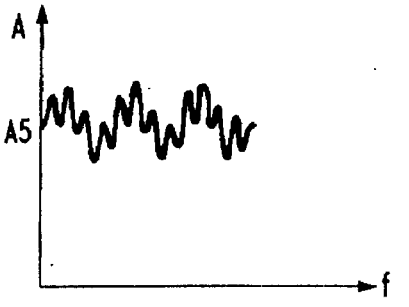
FIGS. 6 and 7 illustrate test frequency waveform diagrams for the signals applied to the test fixture and the output from the telephone handset, respectively.
Figure 7:
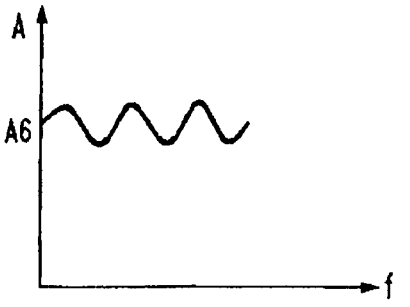

FIGS. 2 and 3 illustrate frequency response diagrams for the test fixture and the telephone handset, respectively; FIGS. 4 and 5 illustrate test frequency diagrams for the signals applied to the test fixture and the output from the telephone handset, respectively; and FIGS. 6 and 7 illustrate test frequency waveform diagrams for the signals applied to the test fixture and the output from the telephone handset, respectively. In particular, the frequency bandwidth of the telephone handset 100 is less than that of the test fixture 110, as shown by the frequency response diagrams of FIGS. 3 and 2, respectively. The frequency response of the test fixture 110 is from frequency F1 to frequency F2, while the frequency response of the telephone handset 100 is from frequency F3 to frequency F4. Thus, the following relationship applies to the system S for assuring proper acoustic connection of a device under test to a test fixture: F2-F1>F4-F3 or, alternatively, the frequency bandwidth of the telephone handset 100 is not totally included in the frequency bandwidth of the test fixture 110. The common requirement of these two cases is that the test fixture frequency bandwidth includes frequencies that are outside of the frequency bandwidth of the telephone handset 100. In operation, the test control processor 115 generates electrical signals that drive the audio output device 111A of the artificial mouth 111 (or alternatively output device 116) to produce the desired audio output. The audio output produced by the artificial mouth 111 comprises the signals illustrated in waveform form in FIG. 6 and in test frequency diagram form in FIG. 4. These test signals TF1 and TF2 of FIG. 4 result in a waveform of FIG. 6 and which translate into a corresponding audio output produced by artificial mouth 111. The telephone handset 100 can only pass test frequency TF2, since test frequency TF1 is outside of the frequency response of the telephone handset 100. Thus, the audio output of the telephone handset 100 in response to receipt of the audio signals of FIG. 4 has the characteristics shown in FIGS. 5 and 7. The test frequency TF1 lies outside the frequency bandwidth of the telephone handset 100 and is therefore blocked from transmission from the handset transmitter 101A to the handset receiver 102A, and thence to the audio detector 112A.

The accuracy of the mounting of the handset 100 in the test fixture can therefore be tested using these above-noted frequency response characteristics of the telephone handset 100 and the test fixture 110. This is accomplished by the test processor 115 activating an initial telephone handset mounting test prior to stepping through the standard telephone handset tests. The test processor 115 activates the artificial mouth 111 to produce frequency TF1 and then monitors the output of the audio detector 112A located in the artificial ear. If the telephone handset 100 is properly mounted in the acoustic coupler 112B of the artificial ear, then the audio signals present external to the telephone handset-acoustic coupler interconnection are substantially blocked from reaching the audio detector 112A and the test process can proceed. If the test frequency TF1 is detected at audio detector 112A, then this fact is indicative that the telephone handset 100 is not properly mounted in the acoustic coupler 112B of the test fixture 110 and the operator is signaled to reinsert the telephone handset 100 into the acoustic coupler 112B before the test proceeds. The test processor 115 then activates the artificial mouth 111 to produce frequency TF2 which is applied to the telephone handset and detected at the audio detector 112A to measure the transmission characteristics of the telephone handset 100. Alternatively, both test frequencies TF1 and TF2 can be simultaneously generated by the operation of the test processor 115. The audio detector 112A should only detect the presence of the test frequency TF2 to indicate the proper mounting of the telephone handset 100 in the acoustic coupler 112B of the test fixture 110. The use of both test frequencies simultaneously ensures that the absence of test frequency TF1 at the audio detector 112A is not due to failure of the audio detector 112A.

In addition, even if the test frequency TF2 is not totally blocked by the mounting of the telephone handset 100 in the test fixture 110, the magnitude of the test frequency TF2 detected indicates the degree of audio leakage. Knowing this fast enables the test processor 115 to accurately determine the true audio output of telephone handset receiver 102A

SUMMARY

The system for assuring proper acoustic connection of a device under test to a test fixture generates an audible test signal external to the telephone handset-acoustic coupler interconnection to test the efficacy of the coupling of the telephone handset to the acoustic coupler of the test fixture. Thus, when the telephone handset is mounted in the acoustic coupler of the test fixture, this acoustic coupling should substantially block all audio signals that are present external to the acoustic coupler-telephone handset interconnection, from reaching the audio detector that is located in the acoustic coupler of the test fixture. Failure to substantially block the external audio signals indicates the inefficient mounting of the telephone handset in the test fixture.

What is claimed:

1. A test fixture apparatus for acoustically testing a device under test having a predetermined frequency bandwidth and which includes an audio receiver that is insertable into an acoustic coupler of an artificial ear of said test fixture apparatus, comprising:

means for producing an audio output, containing at least one predetermined frequency outside of said predetermined frequency bandwidth, external to an interconnection of said audio receiver into said acoustic coupler;

means in said artificial ear, internal to an interconnection of said audio receiver into said acoustic coupler, for generating signals indicative of the presence of said audio output containing said at least one predetermined frequency.

2. The test fixture apparatus of claim 1 further comprising:

means, responsive to absence of said signals indicative of the presence of said audio output of said at least one predetermined frequency, for enabling said test fixture apparatus to execute a test of said device under test.

3. The test fixture apparatus of claim 2 further comprising:

means for blocking execution of said test in response to presence of said signals indicative of the presence of said audio output of said at least one predetermined frequency.

4. The test fixture apparatus of claim 1 wherein said means for producing an audio output comprises:

means for producing a first audio output at a first predetermined frequency, which first predetermined frequency is outside of said predetermined frequency bandwidth; and means for producing a second audio output at a second predetermined frequency, which second predetermined frequency is within said predetermined frequency bandwidth.

5. The test fixture apparatus of claim 4 wherein said means for producing an audio output further comprises:

means for sequentially activating said means for producing a second audio output subsequent to activation of said means for producing a first audio output.

6. The test fixture apparatus of claim 4 wherein said means for producing an audio output further comprises:

means for simultaneously activating said means for producing a second audio output and said means for producing a first audio output.

7. A method of operating a test fixture apparatus for acoustically testing a device under test having a predetermined frequency bandwidth and which includes an audio receiver that is insertable into an acoustic coupler of an artificial ear of said test fixture apparatus, comprising the steps of:

producing an audio output, containing at least one predetermined frequency outside of said predetermined frequency bandwidth, external to an interconnection of said audio receiver into said acoustic coupler;

generating signals in said artificial ear, internal to an interconnection of said audio receiver into said acoustic coupler, indicative of the presence of said audio output containing said at least one predetermined frequency.

8. The method of operating a test fixture apparatus of claim 7 further comprising the step of:

enabling, in response to absence of said signals indicative of the presence of said audio output of said at least one predetermined frequency, said test fixture apparatus to execute a test of said device under test.

9. The method of operating a test fixture apparatus of claim 8 further comprising the step of:

blocking execution of said test in response to presence of said signals indicative of the presence of said audio output of said at least one predetermined frequency.

10. The method of operating a test fixture apparatus of claim 7 wherein said step of producing an audio output comprises:

producing a first audio output at a first predetermined frequency, which first predetermined frequency is outside of said predetermined frequency bandwidth; and producing a second audio output at a second predetermined frequency, which first predetermined frequency is within said predetermined frequency bandwidth.

11. The method of operating a test fixture apparatus of claim 10 wherein said step of producing an audio output further comprises:

sequentially activating said step of producing a second audio output subsequent to activation of said step of producing a first audio output.

12. The method of operating a test fixture apparatus of claim 10 wherein said step of producing an audio output further comprises:

simultaneously activating said step of producing a second audio output and said step of producing a first audio output.

13. A test fixture apparatus for acoustically testing a device under test having a predetermined frequency bandwidth and which includes an audio receiver, comprising:

artificial ear means for receiving said audio receiver of said device under test;

artificial mouth means for producing an audio output external to an interconnection of said audio receiver into said acoustic coupler;

audio detector means located in said artificial ear, internal to an interconnection of said audio receiver into said acoustic coupler, for generating signals indicative of the presence of said audio output;

test processor means for testing said device under test comprising:

means for activating said artificial mouth means to produce an audio output containing at least one predetermined frequency outside of said predetermined frequency bandwidth; and means, responsive to said audio detector means detecting said audio output failing to contain said at least one predetermined frequency, for generating a signal indicative of proper connection of said device under test to said test fixture apparatus.

14. The test fixture apparatus of claim 13 further comprising:

means, responsive to said audio detector means detecting said audio output containing said at least one predetermined frequency, for generating a signal indicative of improper connection of said device under test to said test fixture apparatus.

15. The test fixture apparatus of claim 14 wherein said means for activating comprises:

means for producing a first audio output at a first predetermined frequency, which first predetermined frequency is outside of said predetermined frequency bandwidth; and means for producing a second audio output at a second predetermined frequency, which first predetermined frequency is within said predetermined frequency bandwidth.

16. The test fixture apparatus of claim 15 wherein said means for activating further comprises:

means for sequentially activating said means for producing a second audio output subsequent to activation of said means for producing a first audio output.

17. The test fixture apparatus of claim 15 wherein said means for activating further comprises:

means for simultaneously activating said means for producing a second audio output and said means for producing a first audio output.

* * * * *